US007407381B2

(12) United States Patent
Olstowski

(10) Patent No.: US 7,407,381 B2
(45) Date of Patent: Aug. 5, 2008

(54) COMBUSTION APPARATUS AND METHODS FOR MAKING AND USING SAME

(75) Inventor: Franek Olstowski, Houston, TX (US)

(73) Assignee: PAC, LP, Houston, TX (US)

( * ) Notice: Subject to any disclaimer, the term of this patent is extended or adjusted under 35 U.S.C. 154(b) by 4 days.

(21) Appl. No.: 10/970,686

(22) Filed: Oct. 21, 2004

(65) Prior Publication Data

US 2005/0153253 A1 Jul. 14, 2005

(51) Int. Cl.
*F23D 14/46* (2006.01)

(52) U.S. Cl. ..... 431/350; 431/354

(58) Field of Classification Search ..... 431/350, 431/353, 354, 11, 126; 356/315, 317
See application file for complete search history.

(56) References Cited

U.S. PATENT DOCUMENTS 2,664,779 A * 1/1954 White ..... 356/417
3,516,771 A * 6/1970 Rendina ..... 431/126
4,213,403 A 7/1980 Gomori
4,568,267 A 2/1986 Kendall-Tobias
4,624,565 A * 11/1986 Kiminkinen ..... 356/315
4,755,136 A 7/1988 Gotte
4,790,268 A 12/1988 Eising
4,865,444 A 9/1989 Green et al.
5,000,757 A 3/1991 Puttock et al.
5,153,673 A * 10/1992 Amirav ..... 356/315
5,281,128 A * 1/1994 Dalla Betta et al. ..... 431/7
5,370,529 A * 12/1994 Lu et al. ..... 431/353
5,425,632 A 6/1995 Tsurumi et al.
5,513,982 A 5/1996 Althaus et al.
5,558,515 A 9/1996 Althaus et al.
5,829,967 A 11/1998 Chyou
5,890,886 A 4/1999 Doket et al.
6,155,212 A * 12/2000 McAlister ..... 123/3
6,162,046 A * 12/2000 Young et al. ..... 431/11
6,175,409 B1 * 1/2001 Nielsen et al. ..... 356/337
6,302,683 B1 10/2001 Vestin et al.
6,418,724 B1 7/2002 Cheng
6,497,098 B2 12/2002 Griffin et al.
6,575,617 B2 6/2003 Fleischli et al.
6,762,834 B2 * 7/2004 Komatani et al. ..... 356/315
6,829,048 B2 * 12/2004 Erath ..... 356/315
2003/0152878 A1 8/2003 Staffler et al.
2003/0188486 A1 10/2003 Tanaka et al.

* cited by examiner

*Primary Examiner*—Alfred Basichas

(57) ABSTRACT

A combustion apparatus is disclosed that improves oxidation efficiency without increasing either combustion apparatus size or residence time, where the apparatus includes a combustion zone having a static mixing zone along a length of the combustion zone.

27 Claims, 6 Drawing Sheets

COMBUSTION APPARATUS AND METHODS FOR MAKING AND USING SAME

BACKGROUND OF THE INVENTION

1. Field of the Invention

The present invention relates to an improved combustion apparatus and methods for making and using same.

More particularly, the present invention relates to an improved combustion apparatus including a combustible material inlet, an oxidizing agent inlet, a combustion gas outlet and a combustion zone having at least one in-line or static mixing zone and methods for making and using same.

2. Description of the Related Art

Combustion of combustible materials has always been a challenging and difficult undertaking, especially when the goal is complete oxidation or combustion. Such complete combustion is particularly critical in analytical detectors for determining concentrations of nitrogen and/or sulfur in a sample.

Although many combustion chambers have been designed over the years, most still lack the ability to foster complete combustion in a timely and cost effective manner. Certain combustion chambers have use static mixers to add combustion, but the mixers are either used upstream or down stream of the combustion zone to ensure that the material entering the flame, combustion tube or furnace are homogeneous or to ensure that the effluent gases are homogeneous. Such combustion systems including static mixers are disclosed in U.S. Pat. Nos. 6,575,617; 6,497,098; 6,418,724; 6,302,683; 5,890,886; 5,829,967; 5,558,515; 5,513,982; 5,425,632; 5,000,757; 4,755,136; and 4,213,403.

Thus, there is a need in the art for an improved combustion chamber, which improves combustion efficiency by providing enhanced in-line mixing within the combustion zone or zones.

SUMMARY OF THE INVENTION

The present invention provides an improved combustion apparatus including a combustible material inlet, an oxidizing agent inlet, a combusted gas outlet, and a combustion chamber having a combustion zone including at least one in-line or static mixer or mixing zone, where the mixers or mixing zones improve combustion efficiency without increasing residence time so that larger amounts of the combustible material can be combusted in a same period of time for a same volume of the combustion zone.

The present invention also provides an improved combustion apparatus including a combustible material inlet, an oxidizing agent inlet, a combusted gas outlet, and a combustion chamber having a combustion zone including a plurality of in-line or static mixers or mixing zones, where the mixers or mixing zones improve combustion efficiency without increasing residence time so that larger amounts of the combustible material can be combusted in a same period of time for a same volume of the combustion zone.

The present invention also provides an improved combustion apparatus including a combustible material inlet, an oxidizing agent inlet, a combusted gas outlet, and a combustion chamber having a combustion zone including a plurality of spaced apart in-line or static mixers or mixing zones, where the mixers or mixing zones improve combustion efficiency without increasing residence time so that larger amounts of the combustible material can be combusted in a same period of time for a same volume of the combustion zone.

The present invention also provides an improved furnace apparatus including a combustion apparatus of this invention and a heater adapted to maintain the combustion zone(s) of the combustion apparatus at a temperatures sufficient to convert all or substantially all of the oxidizable components into their corresponding oxides.

The present invention provides an analytical instrument including an improved combustion apparatus of this invention, a sample supply unit adapted to supply a sample to the combustion apparatus, an oxidizing agent supply unit adapted to supply an oxidizing agent to the combustion apparatus, a detector/analyzer unit downstream of the combustion apparatus adapted to receive the oxidized sample and detect detectible oxidized species.

The present invention provides an analytical instrument including an improved combustion apparatus of this invention, a sample supply unit adapted to supply a sample to the combustion apparatus, an oxidizing agent supply unit adapted to supply an oxidizing agent to the combustion apparatus, a detector/analyzer unit downstream of the combustion apparatus adapted to receive the oxidized sample and detect detectible sulfur and/or nitrogen species.

The present invention provides a combustion system including an improved combustion apparatus of this invention, a fuel supply unit adapted to supply a fuel to the combustion apparatus, an oxidizing agent supply unit adapted to supply an oxidizing agent to the combustion apparatus, an exhaust unit downstream of the combustion apparatus adapted to receive and process the oxidized fuel.

The present invention provides a combustion system including an improved combustion apparatus of this invention, a fuel supply unit adapted to supply a fuel to the combustion apparatus, an oxidizing agent supply unit adapted to supply an oxidizing agent to the combustion apparatus, and an energy extraction unit downstream of the combustion apparatus adapted to receive and extract energy from the oxidized fuel.

The present invention provides a method for improving the combustion efficiency including the steps of feeding a combustible material and an oxidizing agent to a combustion apparatus of this invention and combusting or oxidizing the combustible material in the combustion zone(s) of the combustion apparatus where the mixer(s) or mixing zone(s) of the combustion apparatus improve(s) combustion efficiency and increase(s) a throughput of the material being combusted.

DESCRIPTION OF THE DRAWINGS

The invention can be better understood with reference to the following detailed description together with the appended illustrative drawings in which like elements are numbered the same:

FIG. 2E depicts a block diagram of another preferred embodiment of a combustion apparatus of this invention;

DETAILED DESCRIPTION OF THE INVENTION

Figure 1A:
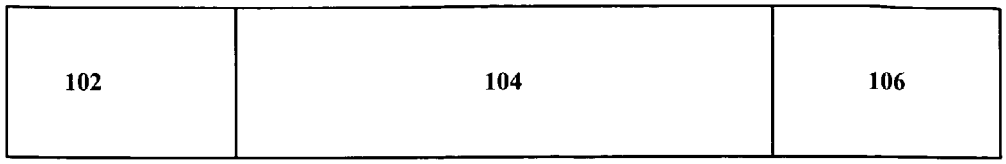
FIG. 1A PRIOR ART
FIG. 1A depicts a block diagram of a prior art combustion apparatus.
Figure 1A:
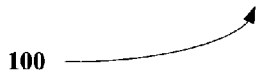
FIG. 1A PRIOR ART
Figure 1B:
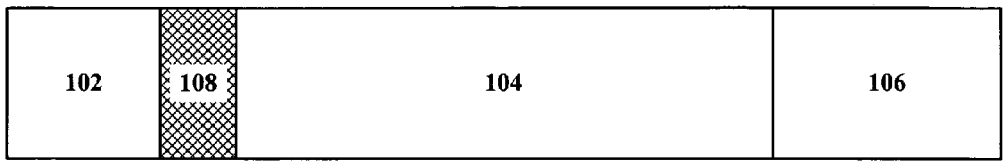
FIG. 1B PRIOR ART
FIG. 1B depicts a block diagram of another prior art combustion apparatus.
Figure 1B:
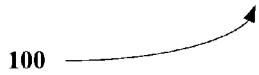
FIG. 1B PRIOR ART
Figure 1C:
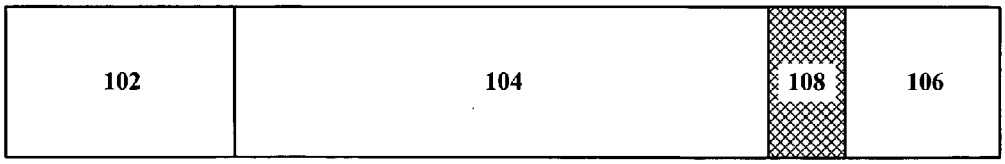
FIG. 1C PRIOR ART
FIG. 1C depicts a block diagram of another prior art combustion apparatus.
Figure 1C:
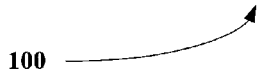
FIG. 1C PRIOR ART
Figure 1D:
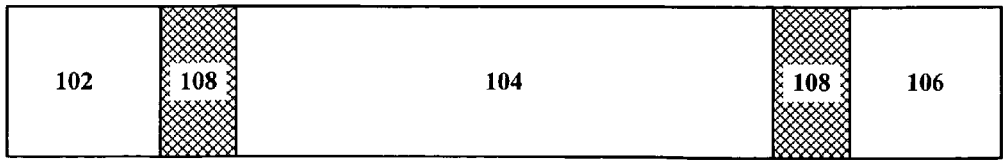
FIG. 1D PRIOR ART
FIG. 1D depicts a block diagram of another prior art combustion apparatus.
Figure 1D:
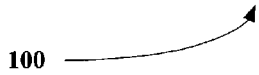
FIG. 1D PRIOR ART

The inventor has found that an improved combustion chamber can be constructed that allows for greater throughput, larger sample sizes and superior combustion profiles and efficiencies without increasing either the combustion volume or the residence time. The process of oxidation of this invention can be viewed like that of a chromatography process in which the separation process tends to broaden peak shape. Similarly, to enhance combustion efficiency, the inventor believes that one should broaden peak shape or profile of the combusting material. The inventor has found that by inserting at least one in-line or static mixer or mixing zone within a conventional combustion or oxidation zone or apparatus such as an oxidation tube, one can vastly improve oxidation efficiency. When such a combustion apparatus in used in analytical chemistry, one can improve detector sensitivity, decrease detector limits and provide greater instrument throughput without increasing either combustion volume or residence time. The combustion apparatus of this invention are ideally suited in applications such as analytical instrumentation, catalytic converters, pyrolysis tubes, conventional combustion tubes, energy extraction plant, power plants, or any other application where improvements in combustion efficiency can yield improved economics, throughput, sensitivity or the like without increasing combustion chamber size or increasing combustion residence time.

The present invention broadly relates to an improved combustion apparatus including a combustible material (fuel or sample) inlet, an oxidizing agent inlet (of course, the two inlets can be combined into a single inlet), a combustion chamber including a combustion zone maintained at an elevated temperature where zone includes at least one in-line or static mixer or mixing zone therein, and an oxidized material outlet, where the apparatus improves combustion efficiency relative to the same apparatus absence the mixing zone. In the case of analytical instrumentation, the combustion apparatuses of this invention not only improve combustion efficiency, the combustion apparatuses of this invention increase instrument throughput, decrease instrument detection limits and increase instrument sensitivity. The elevated temperature is generally above about 300° C. Preferably, the elevate temperature is between about 300° C. and about 2000° C. Particularly, the elevated temperature is between about 600° C. and about 1500° C. More particularly, the elevated temperature is between about 800° C. and about 1300° C. The combustion apparatuses of this invention can be operated at ambient pressure, at reduced pressure down to ten of millimeters of mercury, or at higher than ambient pressures up to a 1000 or more psia.

The present invention broadly relates to a method for improved combustion including the step of feeding a combustible material and an oxidizing agent to an apparatus of this invention to form an oxidized material comprising oxides of all oxidizable components in the material, where the method improves oxidation efficiency relative to the same apparatus in the absence the mixing zone.

The present invention discloses a combustion apparatus comprising an inlet, an outlet, a combustion zone including a mixing zone disposed alone a length of the combustion zone, and a heater, where the inlet is adapted to feed a combustible material and an oxidizing agent to the combustion zone, and the heater is designed to maintain the combustion zone including the mixing zone at an elevated temperature.

The present invention discloses an analytical instrument apparatus comprising a sample supply system and an oxidizing supply system. The apparatus also comprises a combustion or furnace apparatus comprising an inlet, an outlet, a combustion zone including a mixing zone disposed along a length of the combustion zone, and a heater. The apparatus also includes a detector/analyzer unit, where the supply systems are adapted to supply a sample and an oxidizing agent to the inlet of the combustion apparatus, the combustion apparatus is adapted to substantially completely oxidize the sample into oxides and the detector/analyzer is adapted to determine a concentration of at least one oxide and relate the oxide concentration back to a concentration of an element in the sample.

The present invention discloses a method for oxidizing a combustible material comprising the step of feeding the combustible material and an oxidizing agent to a combustion apparatus comprising an inlet, an outlet, a combustion zone including a mixing zone disposed along a length of the combustion zone, and a heater. The method also comprises the step of heating the combustion zone to a temperature sufficient to covert all or substantially all oxidizable components in the combustible material into their corresponding oxides, where the mixing zone increases an efficiency of combustion of the combustion zone.

The present invention discloses a method for analyzing a sample comprising the step of feeding the sample and an oxidizing agent to a combustion apparatus comprising an inlet, an outlet, a combustion zone including a mixing zone disposed along a length of the combustion zone, and a heater. The method also comprises the step of heating the combustion zone to a temperature sufficient to covert all or substantially all oxidizable components in the combustible material into their corresponding oxides. The method also comprises the steps of forwarding the oxides to an detector/analyzer, and detecting a concentration of at least on oxide, where the mixing zone increases an efficiency of combustion of the combustion zone and where the detector/analyzer relates the oxide concentration back to a concentration of an element in the sample.

The present invention discloses an energy extraction apparatus comprising a fuel and oxidizer supply unit, a combustion or furnace apparatus comprising an inlet, an outlet, a combustion zone including a mixing zone disposed along a length of the combustion zone, and a heater and an energy conversion unit for converting a portion of the thermal energy of the oxidized fuel to a more useful form of energy.

The present invention discloses an internal combustion apparatus comprising an internal combustion engine and a catalytic converter including a combustion or furnace apparatus an inlet, an outlet, a combustion zone including a mixing zone disposed along a length of the combustion zone, and a heater.

Suitable Materials

Suitable materials out of which the combustion chambers, tubes or furnaces of this invention can be made includes, without limitation, any durable material which can tolerate combustion temperatures. Preferred materials include, without limitation, metals, glasses, crystalline materials such as quartz, ceramics such as formable silicates, aluminates, zirconate, titanates, or mixed metal oxides, composites, high temperature polymers, or mixtures or combinations of any of the materials provide thermal expansion coefficient differences can be managed. Particularly preferred materials include steels, quartz, alumina, silica, zirconia, or mixtures or combinations thereof. Particularly preferred metal include stainless steels and other non-staining iron, cobalt or nickel alloys.

DETAILED DESCRIPTION OF THE DRAWINGS

Combustion Apparatuses Including In-Line Mixer(s) in the Combustion Zone(s)

Referring now to FIGS. 1A-D, four prior art combustion apparatuses, generally 100, are shown to include an inlet zone 102 where a combustible material and an oxidizing agent are introduced, a combustion zone 104 and an oxidized material outlet zone 106. Looking at FIG. 1A, the prior art combustion apparatus 100 has no other parts, except for a heating means or heater for heating the combustion zone to an elevated temperature. All of the other apparatuses 100 include in-line or static mixers 108. Looking at FIG. 1B, the prior art combustion apparatus 100 includes an upstream in-line mixer 108. The prior art combustion apparatus 100 of FIG. 1C includes a downstream in-line mixer 108. And, the prior art combustion apparatus 100 of FIG. 1D includes both an upstream and a downstream in-line mixer 108.

Figure 2A:
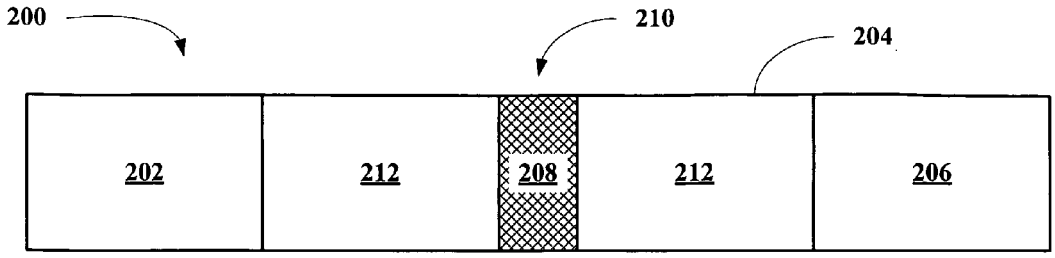
FIG. 2A depicts a block diagram of a preferred embodiment of a combustion apparatus of this invention.

Referring now to FIG. 2A, a preferred embodiment of a combustion apparatus of this invention, generally 200, is shown to include an inlet zone 202, a combustion zone 204 and an oxidized material outlet zone 206, where the combustion zone 204 includes an in-line or static mixing zone 208 in a center 210 of the combustion zone 204 with normal combustion subzones 210 before and after the mixing zone 208. The inlet zone 202 is adapted to introduce a combustible material and an oxidizing agent into the combustion zone 204. The mixing zone 208 is adapted to in-line mixed and broaden an oxidizing mixture profile in the combustion zone 204 improving combustion efficiency, where the oxidizing mixture comprises un-oxidized combustible material components, partially oxidized combustible material components, completely oxidized combustible material components and un-consumed oxidizing agent, at temperature. The nature of the mixing zone 208 can be any standard in-line or static mixer regardless of exact configuration, provided that the mixer augments a flow path of the oxidizing mixture and prevents or eliminates any part of the oxidizing mixture from traveling through the combustion zone 204 in an unaltered straight flow path.

Figure 2B:
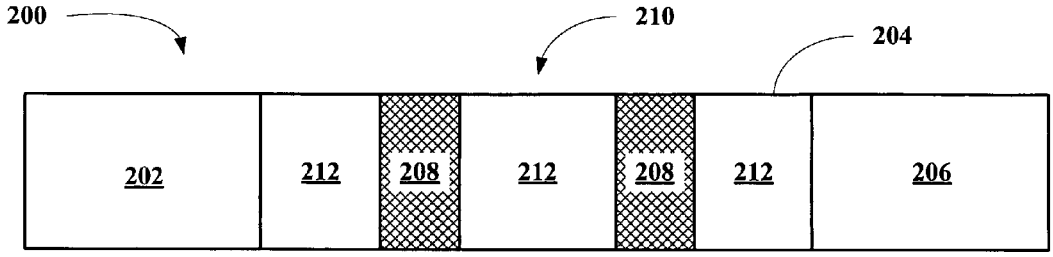
FIG. 2B depicts a block diagram of another preferred embodiment of a combustion apparatus of this invention.

Referring now to FIG. 2B, another preferred embodiment of a combustion apparatus of this invention, generally 200, is shown to include an inlet zone 202, a combustion zone 204 and an oxidized material outlet 206, where the combustion zone 204 includes two spaced apart mixing zones 208 in a center portion 210 of the combustion zone 204 with normal combustion subzones 212 before, after and therebetween. The inlet zone 202 is adapted to introduce a combustible material and an oxidizing agent into the combustion zone 204. An oxidizing mixture comprising un-oxidized combustible material components, partially oxidized combustible material components, completely oxidized combustible material components and un-consumed oxidizing agent are mixed in-line, at temperature improving combustion efficiency in the combustion zone 204 due to the mixing of the oxidizing mixture in the mixing zones 208.

Figure 2C:
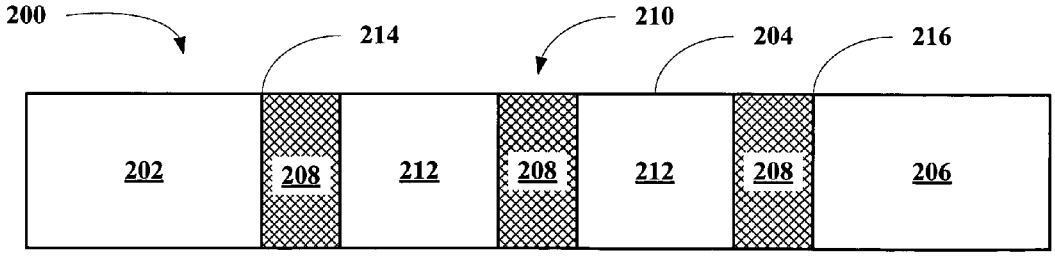
FIG. 2C depicts a block diagram of another preferred embodiment of a combustion apparatus of this invention.

Referring now to FIG. 2C, another preferred embodiment of a combustion apparatus of this invention, generally 200, is shown to include an inlet zone 202, a combustion zone 204 and an oxidized material outlet 206, where the combustion zone 204 includes three spaced apart mixing zones 208, one of the mixing zone 208 is located in a center 210 of the combustion zone 204, two of the mixing zones 208 are located at a first end 214 and a second end 216 of the combustion zone 204 with normal combustion subzones 212 therebetween. The inlet zone 202 is adapted to introduce a combustible material and an oxidizing agent into the combustion zone 204. The in-line mixing zones 208 are designed to increase a combustion efficiency of the combustion zone 204 by mixing an oxidizing mixture at temperature to ensure that a path of the oxidizing mixture is not a straight path or to reduce channeling of portions of the oxidizing mixture as it traverses the combustion zone 204. The oxidizing mixture comprises un-oxidized combustible material components, partially oxidized combustible material components, completely oxidized combustible material components and un-consumed oxidizing agent. Of course, at the outlet zone 206 the effluent includes a completely oxidized mixture or a substantially completely oxidized mixture, where the term substantially completely oxidized means that at least 95% of all of the oxidizable components in the combustible material have been converted to their corresponding oxides, preferably, at least 98% of all of the oxidizable components in the combustible material have been converted to their corresponding oxides, particularly, at least 99% of all of the oxidizable components in the combustible material have been converted to their corresponding oxides and especially, at least 99.9% of all of the oxidizable components in the combustible material have been converted to their corresponding oxides.

Figure 2D:
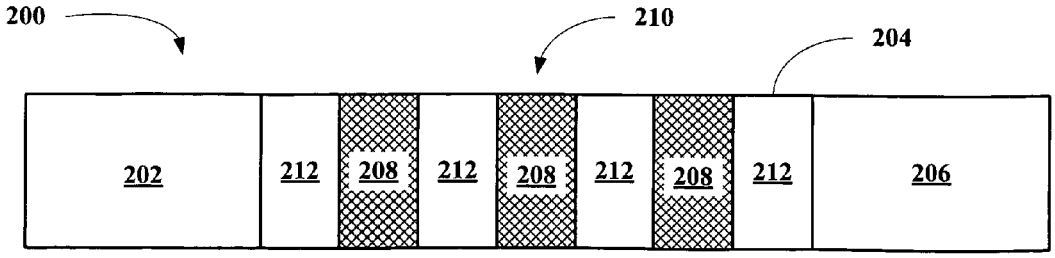
FIG. 2D depicts a block diagram of another preferred embodiment of a combustion apparatus of this invention.

Referring now to FIG. 2D, another preferred embodiment of a combustion apparatus of this invention, generally 200, is shown to include an inlet zone 202, a combustion zone 204 and an oxidized material outlet 206, where the combustion zone 204 includes three spaced apart mixing zones 208 located in a center 210 of the combustion zone 204 with normal combustion subzones 212 before, after and therebetween. The inlet zone 202 is adapted to introduce a combustible material and an oxidizing agent into the combustion zone 204. The in-line mixing zones 208 are designed to increase a combustion efficiency of the combustion zone 204 by mixing an oxidizing mixture at temperature to ensure that a path of the oxidizing mixture is not a straight path or to reduce channeling of portions of the oxidizing mixture as it traverses the combustion zone 204. The oxidizing mixture comprises un-oxidized combustible material components, partially oxidized combustible material components, completely oxidized combustible material components and unconsumed oxidizing agent. Of course, at the outlet zone 206 will include a substantially or completely oxidized mixture, where the term substantially means that at least 95% of the oxidizable components in the combustible material have been converted to their corresponding oxides, preferably, at least 98% of the oxidizable components in the combustible material have been converted to their corresponding oxides, particularly, at least 99% of the oxidizable components in the combustible material have been converted to their corresponding oxides and especially, at least 99.9% of the oxidizable components in the combustible material have been converted to their corresponding oxides.

Figure 3A:
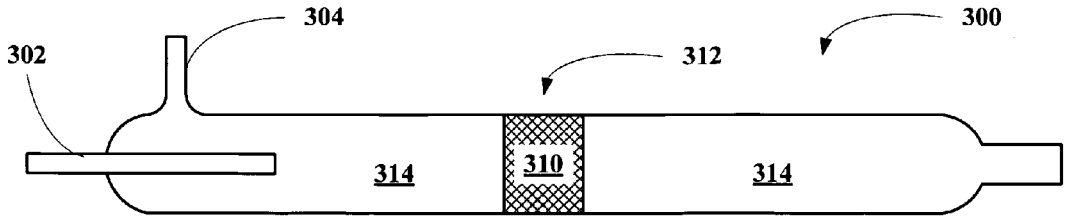
FIG. 3A depicts a block diagram of a preferred embodiment of a combustion tube of this invention.

Referring now to FIG. 3A, another preferred embodiment of a combustion tube apparatus of this invention, generally 300, is shown to include a sample inlet 302, an oxidizing agent inlet 304, a combustion zone 306 and an oxidized material outlet 308, where the combustion zone 306 includes a mixing zone 310 in a center 312 of the combustion zone 306 with normal combustion subzones 314 on either side of the mixing zone 310. The sample inlet 302 is adapted to introduce a combustible material into the combustion zone 306, while the oxidizing agent inlet 304 is adapted to introduce an oxidizing agent into the combustion zone 306. The in-line mixing zone 310 is designed to increase a combustion efficiency of the combustion zone 306 by mixing an oxidizing mixture at temperature to ensure that a path of the oxidizing mixture is not a straight path or to reduce channeling of portions of the oxidizing mixture as it traverses the combustion zone 306. The oxidizing mixture comprises un-oxidized combustible material components, partially oxidized combustible material components, completely oxidized combustible material components and unconsumed oxidizing agent. Of course, at the outlet zone 308 will include a substantially or completely oxidized mixture, where the term substantially means that at least 95% of the oxidizable components in the combustible material have been converted to their corresponding oxides, preferably, at least 98% of the oxidizable components in the combustible material have been converted to their corresponding oxides, particularly, at least 99% of the oxidizable components in the combustible material have been converted to their corresponding oxides and especially, at least 99.9% of the oxidizable components in the combustible material have been converted to their corresponding oxides.

Figure 3B:
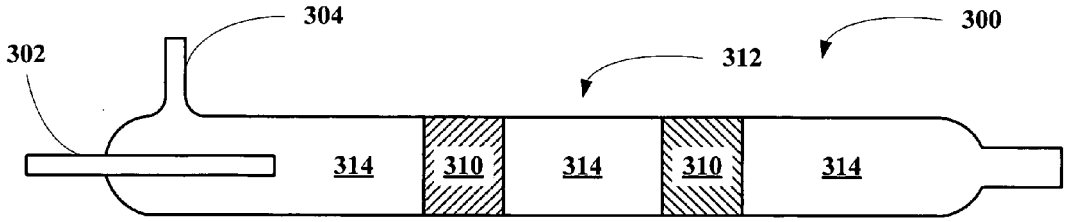
FIG. 3B depicts a block diagram of another preferred embodiment of a combustion tube of this invention.

Referring now to FIG. 3B, another preferred embodiment of a combustion tube apparatus of this invention, generally 300, is shown to include a sample inlet 302, an oxidizing agent inlet 304, a combustion zone 306 and an oxidized material outlet 308, where the combustion zone 306 includes two mixing zones 310 within the combustion zone 306 with normal combustion subzones 314 before, after and therebetween. The sample inlet 302 is adapted to introduce a combustible material into the combustion zone 306, while the oxidizing agent inlet 304 is adapted to introduce an oxidizing agent into the combustion zone 306. The in-line mixing zone 310 are designed to increase a combustion efficiency of the combustion zone 306 by mixing an oxidizing mixture at temperature to ensure that a path of the oxidizing mixture is not a straight path or to reduce channeling of portions of the oxidizing mixture as it traverses the combustion zone 306. The oxidizing mixture comprises un-oxidized combustible material components, partially oxidized combustible material components, completely oxidized combustible material components and un-consumed oxidizing agent. Of course, at the outlet zone 308 will include a substantially or completely oxidized mixture, where the term substantially means that at least 95% of the oxidizable components in the combustible material have been converted to their corresponding oxides, preferably, at least 98% of the oxidizable components in the combustible material have been converted to their corresponding oxides, particularly, at least 99% of the oxidizable components in the combustible material have been converted to their corresponding oxides and especially, at least 99.9% of the oxidizable components in the combustible material have been converted to their corresponding oxides.

Figure 3C:
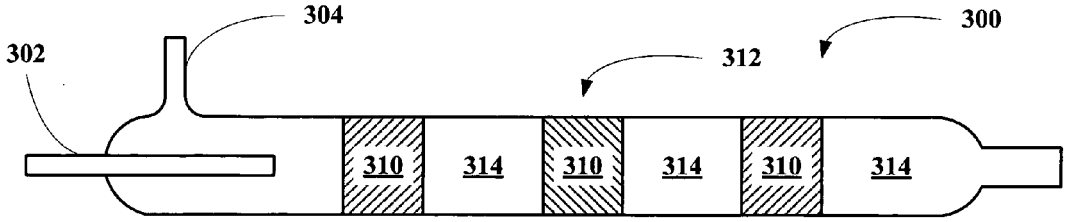
FIG. 3C depicts a block diagram of another preferred embodiment of a combustion tube of this invention.

Referring now to FIG. 3C, another preferred embodiment of a combustion tube apparatus of this invention, generally 300, is shown to include a sample inlet 302, an oxidizing agent inlet 304, a combustion zone 306 and an oxidized material outlet 308, where the combustion zone 306 includes three mixing zones 310 within the combustion zone 306 with normal combustion subzones 314 therebetween. The sample inlet 302 is adapted to introduce a combustible material into the combustion zone 306, while the oxidizing agent inlet 304 is adapted to introduce an oxidizing agent into the combustion zone 306. The in-line mixing zone 310 are designed to increase a combustion efficiency of the combustion zone 306 by mixing an oxidizing mixture at temperature to ensure that a path of the oxidizing mixture is not a straight path or to reduce channeling of portions of the oxidizing mixture as it traverses the combustion zone 306. The oxidizing mixture comprises unoxidized combustible material components, partially oxidized combustible material components, completely oxidized combustible material components and unconsumed oxidizing agent. Of course, at the outlet zone 308 will include a substantially or completely oxidized mixture, where the term substantially means that at least 95% of the oxidizable components in the combustible material have been converted to their corresponding oxides, preferably, at least 98% of the oxidizable components in the combustible material have been converted to their corresponding oxides, particularly, at least 99% of the oxidizable components in the combustible material have been converted to their corresponding oxides and especially, at least 99.9% of the oxidizable components in the combustible material have been converted to their corresponding oxides.

Figure 3D:
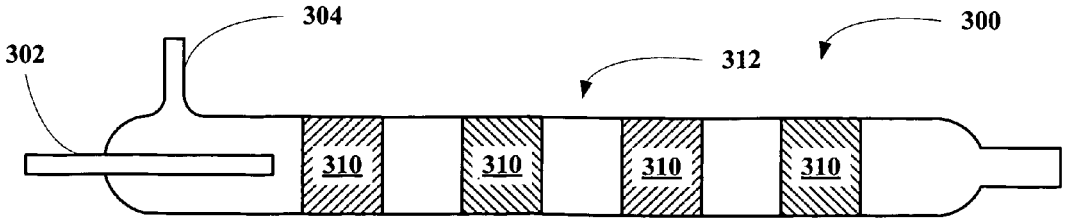
FIG. 3D depicts a block diagram of another preferred embodiment of a combustion tube of this invention.

Referring now to FIG. 3D, another preferred embodiment of a combustion tube apparatus of this invention, generally 300, is shown to include a sample inlet 302, an oxidizing agent inlet 304, a combustion zone 306 and an oxidized material outlet 308, where the combustion zone 306 includes four mixing zones 310 within the combustion zone 306 with normal combustion subzones 314 before, after and therebetween. The sample inlet 302 is adapted to introduce a combustible material into the combustion zone 306, while the oxidizing agent inlet 304 is adapted to introduce an oxidizing agent into the combustion zone 306. The in-line mixing zone 310 are designed to increase a combustion efficiency of the combustion zone 306 by mixing an oxidizing mixture at temperature to ensure that a path of the oxidizing mixture is not a straight path or to reduce channeling of portions of the oxidizing mixture as it traverses the combustion zone 306. The oxidizing mixture comprises un-oxidized combustible material components, partially oxidized combustible material components, completely oxidized combustible material components and un-consumed oxidizing agent. Of course, at the outlet zone 308 will include a substantially or completely oxidized mixture, where the term substantially means that at least 95% of the oxidizable components in the combustible material have been converted to their corresponding oxides, preferably, at least 98% of the oxidizable components in the combustible material have been converted to their corresponding oxides, particularly, at least 99% of the oxidizable components in the combustible material have been converted to their corresponding oxides and especially, at least 99.9% of the oxidizable components in the combustible material have been converted to their corresponding oxides.

In-Line Mixer Designs

Figure 4A:
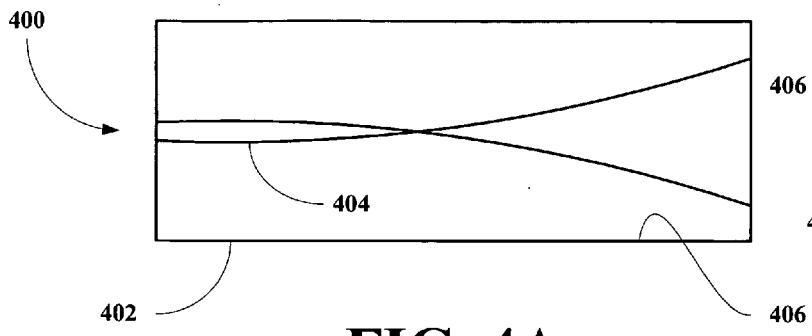
FIGS. 4A-G depict a preferred embodiments of a static mixer.
Figure 4B:
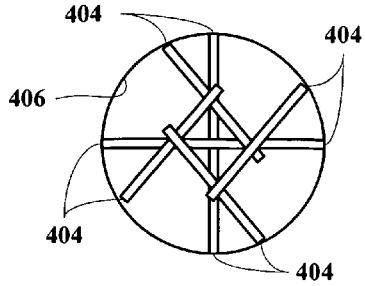

Referring now to FIGS. 4A-G, a number of different in-line or static mixers, generally 400. Looking at FIGS. 4A&B, the mixer 400 includes a housing 402 and a plurality of twisted plates 404 fitted in, attached to, bonded to or integral with an interior surface 406 of the housing 402, where the housing can be the combustion apparatus or tube. FIG. 4A shows a single plate 404, while FIG. 4B shows four plates 404 oriented into a right handed configuration. Obviously, the plates can be arranged in either a right handed configuration, a left handed configuration or a combination of the two configurations.

Figure 4C:
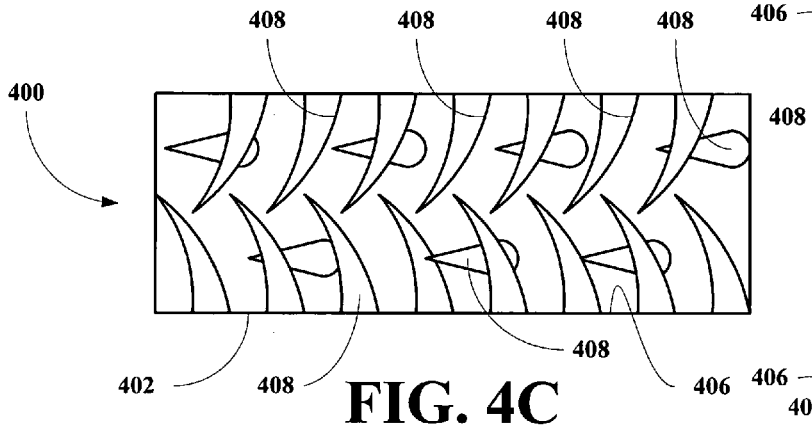
Figure 4D:
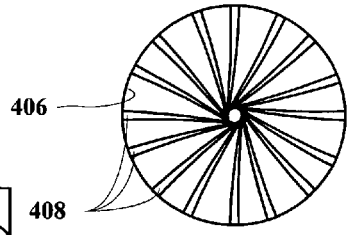
Figure 4E:
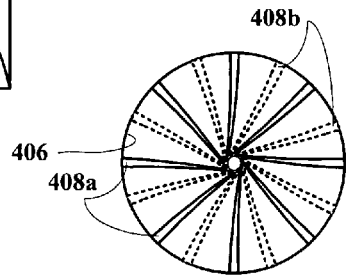

Looking at FIGS. 4C-E, the mixer 400 includes a housing 402 and a plurality of curved protrusions 408 fitted in, attached to, bonded to or integral with (pushed in) an interior surface 406 of the housing 402, where the housing can be the combustion apparatus or tube. The protrusions 408 can be oriented in a right handed configuration 408*a*, a left handed configuration 408*b* or a combination of the two configurations as shown in FIG. 4E.

Figure 4F:
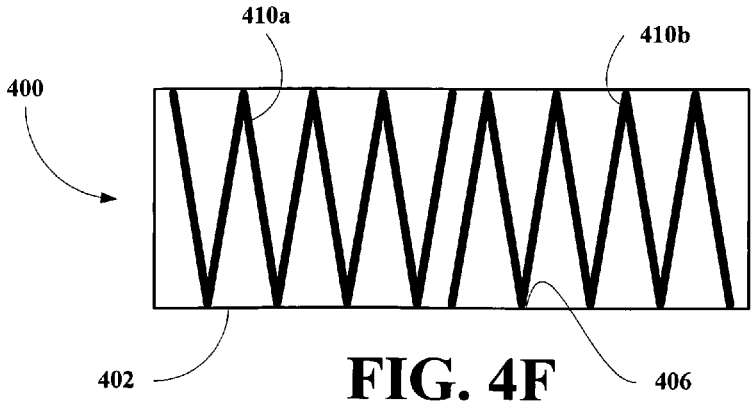
Figure 4G:
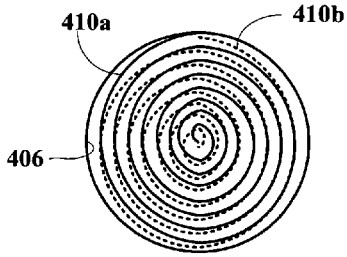

Looking at FIGS. 4F&G, the mixer 400 includes a housing 402 and two helical protrusions 410*a*&*b* fitted in, attached to, bonded to or integral with an interior surface 406 of the housing 402, where the housing can be the combustion apparatus or tube. The helical protrusion 410*a* is in a right handed configuration, while the helical protrusion 410*b* is in a left handed configuration and the two protrusions are located in series as shown in FIGS. 4F&G. Of course, the right handed mixer 410*a* and the left handed mixer 410*b* can be reversed in their order of occurrence.

In all of the mixers shown above, the protrusions or mixing elements all extend more than half way into a cross-section of the combustion zone to ensure that no direct path exist for the oxidizing mixture to travel from the inlet to the outlet, i.e., the mixing elements ensure that the oxidizing mixture undergoes a mixing during the combustion process to increase oxidation efficiency without increasing a volume of the combustion zone or the residence time in the combustion zone.

Energy Extraction Apparatus

Figure 5:
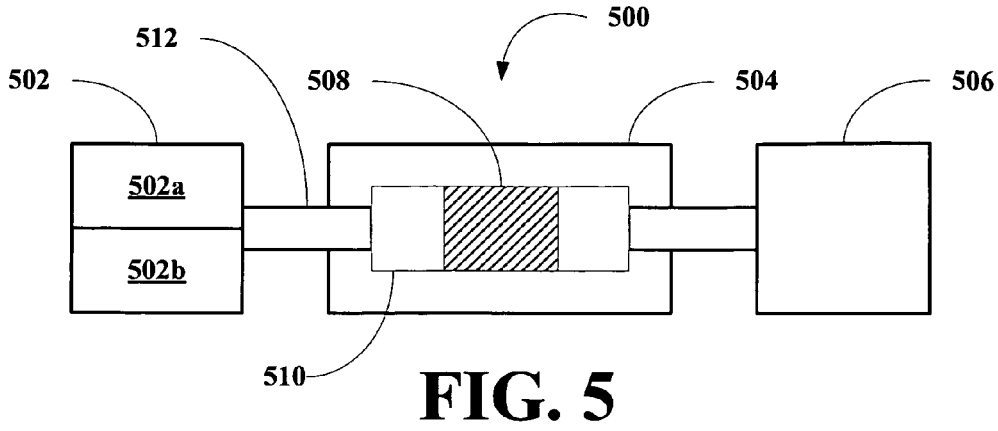
FIG. 5 depicts a block diagram of a preferred embodiment of an energy extraction unit of this invention.

Referring now to FIG. 5, a preferred embodiment of an energy extraction system of this invention, generally 500, is shown to include a fuel and an oxidizing agent supply unit 502, a furnace or combustion chamber 504 and an energy generation unit 506, where the combustion chamber 504 includes a combustion zone 508 having at least one static mixing zone 510. The supply unit 502 can include separate supplies units 502*a*&*b* for fuel and oxidizer and can also include a mixing or atomization unit 512 upstream of the furnace 504. The supply unit 502 supplies fuel and oxidizing agent to the furnace 504, which burns the fuel generating heat which is used as the heat source to the energy generation unit 506, which can be any type of energy generator such as a Kalina type cycle. See, e.g., U.S. Pat. Nos. 5,953,918; 5,950,433; 5,822,990; 5,649,426; 5,588,298; 5,572,871; 5,450,821; 5,440,882; 5,095,708; 5,029,444; 4,982,568; 4,899,545; 4,763,480; 4,732,005; 4,604,867; 4,586,340; 4,548,043; 4,489,563; 4,346,561; and 4,289,429, incorporated herein by reference.

Analytical Instruments

Figure 6:
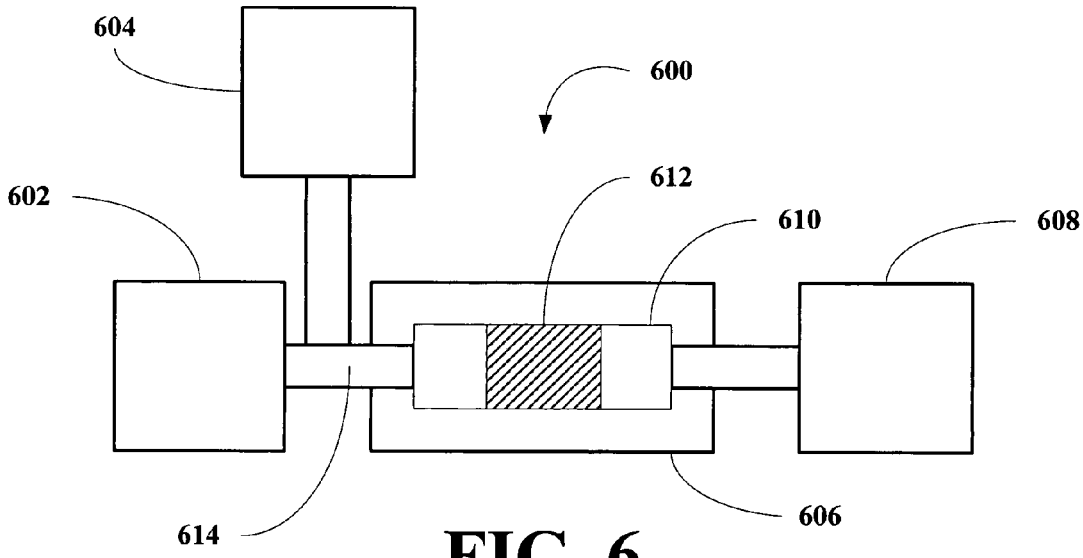
FIG. 6 depicts a block diagram of a preferred embodiment of an analytical instrument of this invention.

Referring now to FIG. 6, a preferred embodiment of an instrument of this invention, generally 600, is shown to include a sample supply system 602, an oxidizing agent supply system 604, a combustion chamber 606 and a detection/analyzer system 608, where the combustion chamber 606 includes a combustion zone 610 having at least one static mixing zone 612. The instrument 600 can also include a mixing or nebulizing unit 614 upstream of the combustion chamber 606 adapted to supply a thoroughly mixed sample and oxidizing agent mixture to the combustion chamber 606 or an atomized sample and oxidizing agent mixture to the combustion chamber 606. The sample supply system 602 can be any sample supply system including an auto-sampler, a septum for direct injection, a sampling loop for continuous sampling, an analytical separation system such as a GC, LC, MPLC, HPLC, LPLC, or any other sample supply system used now or in the future to supply samples to analytical instrument combustion chambers or mixture or combinations thereof. The detector/analyzer system 608 can be any now know or yet to be developed oxide detection and analyzing system including, without limitation, IR spectrometers, FTIR spectrometers, MS spectrometers, UV spectrometers, UV fluorescence spectrometers, chemiluminescence spectrometers, ICR spectrometers, any other spectrographic detection and analyzing system or mixtures or combinations thereof. Preferred instruments include UV fluorescence spectrometers, chemiluminescence spectrometers, or mixtures or combinations thereof.

The improved mixing combustion chambers of this invention also increase sample throughput, decrease instrument cycle times, increase detection sensitivity, and decrease detection limits for different detectible oxides.

Catalytic Converters

Figure 7:
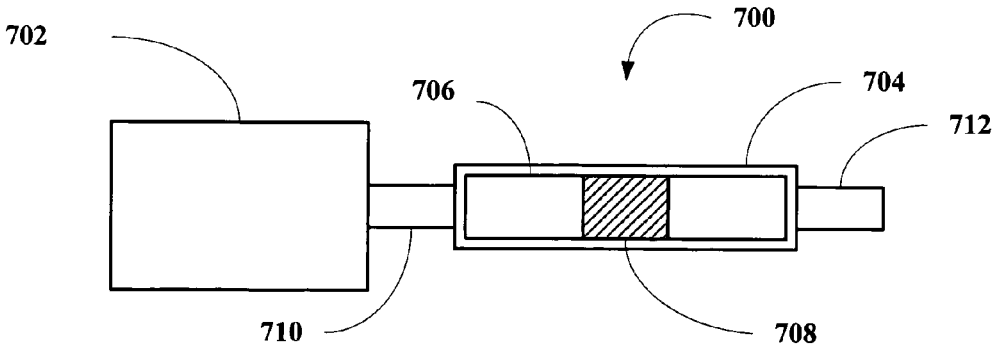
FIG. 7 depicts a block diagram of a preferred embodiment of an internal combustion engine with a catalytic converter of this invention.

Referring now to FIG. 7, a preferred embodiment of an internal combustion engine equipped with a catalytic converter of this invention, generally 700, is shown to include an internal combustion engine 702 and a catalytic converter apparatus 704, where the catalytic converter apparatus 704 includes a combustion zone 706 having at least one static mixing zone 708 therein. The converter 704 is connected to the engine 702 via a header 710 and exhaust gases exit via an exhaust pipe 712.

Figure 8A:
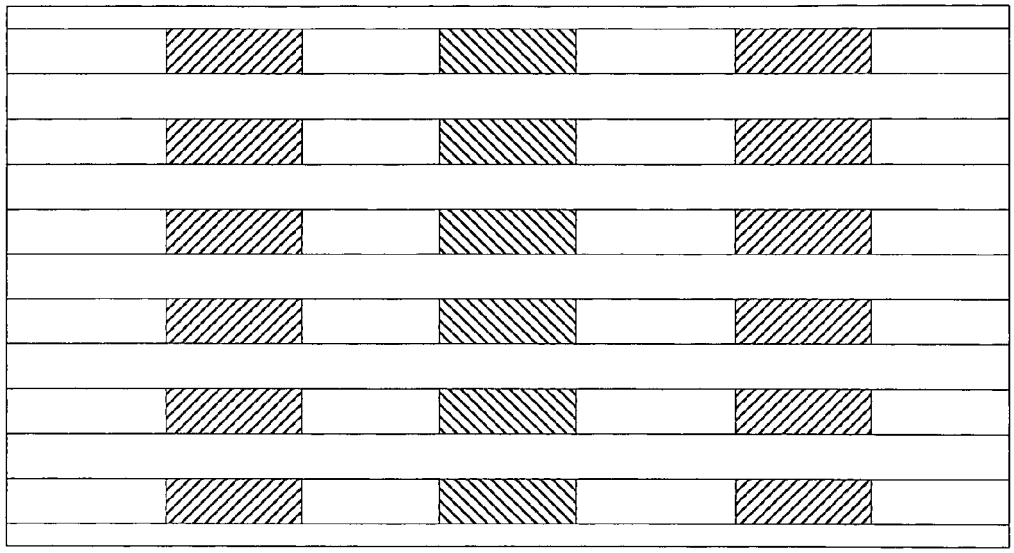
FIGS. 8A&B depict a block diagram of a preferred embodiment of a catalytic converter monolith of this invention.
Figure 8B:
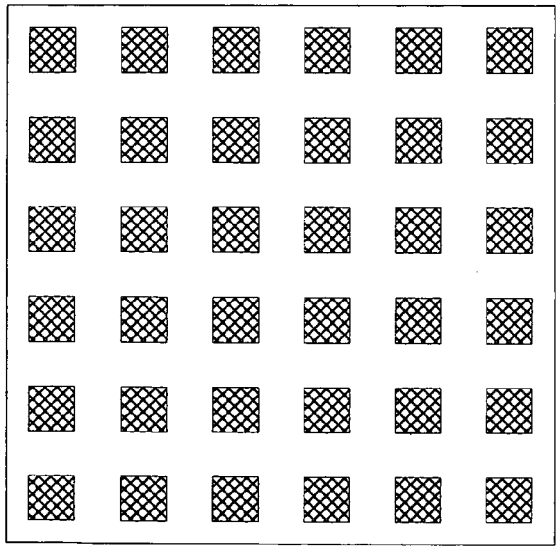

Referring now to FIGS. 8A&B, a preferred embodiment of an catalytic converter monolith, generally 800, is shown to include a plurality of channels 802, each channel 802 including at least one static mixer 804.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. An analytical instrument apparatus comprising:

a sample supply system, an oxidizing supply system, a combustion or furnace apparatus comprising:

an inlet, an outlet, a combustion zone including a mixing zone comprising a static mixer disposed along a length of the combustion zone downstream of the inlet, and a heater, and a detector/analyzer unit, where the supply systems are adapted to supply a sample and an oxidizing agent to the inlet of the combustion apparatus, the heater is adapted to maintain the combustion zone including the mixing zone at an elevated temperature sufficient to substantially completely oxidize the sample into oxides, the static mixer is exposed to combustion temperatures and is adapted to reduce channeling of portions of an oxidizing mixture as it traverses the combustion zone, and the detector/analyzer is adapted to determine a concentration of at least one oxide and relate the oxide concentration back to a concentration of an element in the sample.

2. The apparatus of claim 1, wherein the elevated temperature above about 300° C.

3. The apparatus of claim 1, wherein the elevated temperature between about 300° C. and about 2000° C.

4. The apparatus of claim 1, wherein the elevated temperature between about 600° C. and about 1500° C.

5. The apparatus of claim 1, wherein the elevated temperature between about 800° C. and about 1300° C.

6. The apparatus of claim 1, wherein the combustion apparatus further comprises a nebulizer disposed between the inlet and the combustion zone.

7. The apparatus of claim 1, wherein the sample supply system is selected from the group consisting of an autosampler, a septum for direct injection, a sampling loop for continuous sampling, an analytical separation system and mixture or combinations thereof.

8. The apparatus of claim 7, wherein the analytical separation system is selected from the group consisting of a GC, an LC, an MPLC, an HPLC, an LPLC, and mixtures or combinations thereof.

9. The apparatus of claim 1, wherein the detector/analyzer is selected from the group consisting of IR spectrometers, FTIR spectrometers, MS spectrometers, UV spectrometers, UV fluorescence spectrometers, chemiluminescence spectrometers, ICR spectrometers, and mixtures or combinations thereof.

10. The apparatus of claim 1, wherein the detector/analyzer is selected from the group consisting of UV fluorescence spectrometers, chemiluminescence spectrometers, and mixtures or combinations thereof.

11. The apparatus of claim 1, wherein the combustion zone includes a plurality of mixing zones, where each mixing zone comprises a static mixer and where all of the static mixer are disposed along a length of the combustion zone downstream of the inlet, are exposed to combustion temperatures and are adapted to reduce channeling of portions of an oxidizing mixture as it traverses the combustion zone.

12. A method for oxidizing a combustible material comprising the steps of:

feeding the combustible material and an oxidizing agent to a combustion apparatus comprising an inlet, an outlet, a combustion zone including a mixing zone comprising a static mixer disposed along a length of the combustion zone downstream of the inlet, and a heater for heating the combustion zone, and heating the combustion zone including the mixing zone to a temperature sufficient to covert all or substantially all oxidizable components in the combustible material into their corresponding oxides, where the static mixer is exposed to combustion temperatures and is adapted to reduce channeling of portions of an oxidizing mixture as it traverses the combustion zone and where the mixing zone increases an efficiency of combustion of the combustion zone.

13. The method of claim 12, wherein the temperature is above about 300° C.

14. The method of claim 12, wherein the temperature is between about 300° C. and about 2000° C.

15. The method of claim 12, wherein the temperature is between about 600° C. and about 1500° C.

16. The method of claim 12, wherein the temperature is between about 800° C. and about 1300° C.

17. The method of claim 12, wherein the combustion apparatus further comprises a nebulizer disposed between the inlet and the combustion zone.

18. The method of claim 17, wherein the combustion zone includes a plurality of mixing zones, where each mixing zone comprises a static mixer and where all of the static mixer are disposed along a length of the combustion zone downstream of the inlet, are exposed to combustion temperatures and are adapted to reduce channeling of portions of an oxidizing mixture as it traverses the combustion zone.

19. A method for analyzing a sample comprising the steps of:

feeding the sample and an oxidizing agent to a combustion apparatus comprising an inlet, an outlet, a combustion zone including a mixing zone disposed along a length of the combustion zone downstream of the inlet, and a heater for heating the combustion zone, heating the combustion zone including the mixing zone to a temperature sufficient to covert all or substantially all oxidizable components in the combustible material into their corresponding oxides, and forwarding the oxides to an detector/analyzer, and detecting a concentration of at least on oxide, where the static mixer is exposed to combustion temperatures and is adapted to reduce channeling of portions of an oxidizing mixture as it traverses the combustion zone and where the mixing zone increases an efficiency of combustion of the combustion zone and where the detector/analyzer relates the oxide concentration back to a concentration of an element in the sample.

20. The method of claim 19, wherein the temperature above about 300° C.

21. The method of claim 19, wherein the temperature between about 300° C. and about 2000° C.

22. The method of claim 19, wherein the temperature between about 600° C. and about 1500° C.

23. The method of claim 19, wherein the temperature between about 800° C. and about 1300° C.

24. The method of claim 19, wherein the combustion apparatus further comprises a nebulizer disposed between the inlet and the combustion zone.

25. The method of claim 19, wherein the detector/analyzer is selected from the group consisting of IR spectrometers, FTIR spectrometers, MS spectrometers, UV spectrometers, UV fluorescence spectrometers, chemiluminescence spectrometers, ICR spectrometers, and mixtures or combinations thereof.

26. The method of claim 19, wherein the detector/analyzer is selected from the group consisting of UV fluorescence spectrometers, chemiluminescence spectrometers, and mixtures or combinations thereof.

27. The method of claim 19, wherein the combustion zone includes a plurality of mixing zones, where each mixing zone comprises a static mixer and where all of the static mixer are disposed along a length of the combustion zone downstream of the inlet, are exposed to combustion temperatures and are adapted to reduce channeling of portions of an oxidizing mixture as it traverses the combustion zone.

* * * * *